United States Patent [19]

Krueger

[11] 4,104,941

[45] Aug. 8, 1978

[54] ASSEMBLY FOR ENABLING CLOSE TOLERANCE PUNCHING WITH A REUSABLE SYSTEM

[75] Inventor: Clarence L. Krueger, Williamsville, N.Y.

[73] Assignee: S. B. Whistler & Sons, Inc., Tonawanda, N.Y.

[21] Appl. No.: 824,155

[22] Filed: Aug. 12, 1977

Related U.S. Application Data

[63] Continuation-in-part of Ser. No. 725,259, Sep. 21, 1976, abandoned.

[51] Int. Cl.[2] ..... B26F 1/14

[52] U.S. Cl. ..... 83/133; 83/139; 83/619; 83/620; 83/637

[58] Field of Search ..... 83/132, 133, 139, 619, 83/620, 637

[56] References Cited

U.S. PATENT DOCUMENTS

| | | | |
|---|---|---|---|
| 3,125,917 | 3/1964 | Smeets | 83/619 X |
| 3,186,284 | 6/1965 | Bennett | 83/637 X |
| 3,301,112 | 1/1967 | Peterson | 83/637 X |
| 3,608,413 | 9/1971 | Borello | 83/133 |
| 3,848,452 | 11/1974 | Gargrave | 83/637 X |
| 3,871,254 | 3/1975 | Whistler, Jr. et al. | 83/139 |

*Primary Examiner*—Frank T. Yost

[57] ABSTRACT

An assembly adapted for use in substantially increasing the accuracy of a reusable type punching system features a floating locater or guide templet and associated stripper-punch tip guide element to accurately, positionally locate a punch relative to an associated die part.

6 Claims, 3 Drawing Figures

ASSEMBLY FOR ENABLING CLOSE TOLERANCE PUNCHING WITH A REUSABLE SYSTEM

REFERENCE TO RELATED APPLICATION

This application is a continuation-in-part of copending application Ser. No. 725,259, filed Sept. 21, 1976, now abandoned.

BACKGROUND OF THE INVENTION

Prior U.S. Pat. No. 3,125,917 discloses a punch and die assembly comprising upper and lower plates or templets serving to positionally locate the upper and lower ends of punch and die elements in supported engagement with punch and die shoes, respectively; an intermediate plate or templet fixed to the die shoe via lower portions of shoe guide device and serving to positionally locate the dies of the die elements; and a moveable plate means or locater templet means movably suspended below the punch shoe via upper portions of the punch shoe guide devices and carrying a plurality of guide elements or buttons having openings sized to slideably receive the punching or tip ends of the punch elements in order to orient same relative to their associated dies. Stripper devices in the form of coil type compression springs dispose concentrically of the die elements for opposite end bearing engagement with a lower surface of the upper plate and an upper surface of an associated guide button. The spring devices, working through the guide buttons, additionally function to normally bias removable plate means to bottom out against an abutment defined by upper portions of a shoe guide devices.

In one embodiment of the assembly, lower surfaces of the guide buttons project below a lower surface of the moveable plate means for stripping engagement with a workpiece.

The moveable plate means is illustrated and described as including two or more identical plates or templets, which are clamped in surface-to-surface engagement and appear to individually be of a thickness corresponding to that of the upper, lower and intermediate plates; such thickness being such as to permit punch forming of the guide or locater aperatures in such plates. Apparently, as workpieces of increasing thickness are to be punched, the number of plates comprising the moveable plate means must be increased for stiffening purposes.

Applicant became aware of U.S. Pat. No. 3,125,917 as a result of prosecution of his above mentioned patent application, and subsequently conducted tests in an effort to compare the performance capabilities of the patented system with those of the system disclosed in his application.

In that the patented system was not available for test purposes, Applicant's system was modified in an effort to simulate operational conditions of the patented system. In this respect, Applicant's die set was modified by removing stripper sleeves 138, and by modifying pin support devices 82, such that they supported templet 80 to position guide elements or buttons 90 in essential surface-to-surface abutting engagement with the lower ends of stripper sleeves 60, when the punch shoe 20 is disposed in an operative or die set open condition. As modified, pin supports 82 and stripper sleeves 60 are believed to functionally replace the abutment device defined by said screw 47 and shoulder 40 and stripping springs 65 of the system disclosed in U.S. Pat. No. 3,125,917.

For reference test purposes, die set illustrated in Applicant's application was set up to insure that the spacing between guide sleeves 126 and guide bushings 132 permitted compression of stripper sleeves 138 no later than stripper sleeves 60, when a stock or workpiece thickness of 0.1 inch was being punched; this dictating that the initial spacing of approximately 0.1 inch is present between the bottom of stripper sleeves 60 and the upper surfaces of their associated guide buttons 90, when the latter are fully seated relative to templet 80.

A series of four reference tests were conducted with first and second tests using 0.001 inch thick stock or workpiece material and differing from one another only in that in a first test the stock was "full-sized" to permit all punches to be simultaneously operative and in a second test the stock was "half-sized", so that only one half of the punches arranged on one side or half of the die set were operative. The third and fourth tests were conducted using 0.1 inch thick stock or workpiece material with the "full and half sized" punching conditions of the first and second tests being repeated, respectively. Results of the referenced tests demonstrated the substantially increased accuracy described in Applicant's patent application.

A series of four comparison tests were conducted using Applicant's die set modified in the manner described above with stock thicknesses and sizes identical to those used in the referenced tests. In conducting the comparison tests, the same punch and die elements were used, as those used in the referenced tests; such punch and die elements having been inspected prior to conducting the comparison tests and no damage or wear being noted as a result of the reference tests. Also, in conducting the comparison tests, the single, thin locater templet used in reference tests was used in place of the multiple thickness moveable plate means disclosed in U.S. Pat. No. 3,125,917.

The results of the first three comparison tests were found to be comparable to the results of the first three reference tests. However, when the fourth comparison test was conducted on 0.1 inch stock, using a "half-size" workpiece, it was found that the punch tips of the operative punches failed during the first press stroke; such failure being in the form of a shearing away of a portion of the cutting edge or corner of each of the operable punches, due to misalignment between such operable punches and their assorted dies. A sheared portion of the punches was left, as a deposit on the workpiece, and its presence was readily detectable by visual observation.

Failure of punches during the fourth comparison test is attributable to "cocking" or the non-parallel relationship of the guide templet relative to the die templet, during the punching operation. This results from failure of the prior patented system to provide support, i.e. clamp, to corners of the guide templet prior to compression of the stripped sleeves associated with the punches.

The reason for conducting the second and fourth tests using "half-sized" workpieces, and thus rendering only one half of the available punches operative at a given time, was to permit simulation of "multi-station" operation of the die set. In this connection, it will be understood that it is conventional to design a single die set with its punches and die elements arranged to create multiple stations, whenever it is desirable to provide for multiple hits to be performed on a single workpiece, as when the holes required to be formed in such workpiece are too close together to permit punching in a single operation, or where it is desired to punch different hole patterns in a plurality of small workpieces, which may vary in thickness, within a single press.

SUMMARY OF THE INVENTION

The present invention is directed toward a system adapted to substantially increase the accuracy of or reduce the center-to-center tolerances achievable with reusable punching systems of the type disclosed for instance in U.S. Pat. Nos. 2,364,834; 3,089,376; and 3,782,186.

More specifically, the present invention features the provision of a floating locater or guide templet, which is adapted to be positioned intermediate the punch and die templets of a die set and serves to positionally locate and slideably support a stripper-punch tip guide element or button for free floating movement normal to the plane of the locater templet. The guide element is formed with a through opening sized to slideably receive the tip end of a punch element and arranged for opposite surface engagement with a resiliently deformable stripper sleeve and a workpiece to be punched. The locater or guide templet is in the form of a single, thin metal plate, whose thickness corresponds essentially to the thickness of the punch and die templets.

During a punching operation, corner located guide assemblies serve to positionally locate the locater templet relative to the punch and die templets, whereby to provide for accurate alignment of the tip ends of the punch elements relative to their associated dies.

The present system employs stripper sleeves disposed concentrically of the guide assemblies for bearing engagement with the locater templet and stripper sleeves disposed concentrically of the punch elements for bearing engagement with the guide elements or stripper buttons. The parts are sized to insure substantially simultaneous compression of both sets of stripper sleeves when a given maximum thickness workpiece is being punched, and to provide an initial spacing between the lower ends of the stripper sleeves surrounding the punch elements and the upper surfaces of their associated guide elements, when fully seated relative to the locater templet, corresponding essentially to such maximum thickness. Thus, when a workpiece being punched is of a thickness less than such maximum thickness, compression of the stripper sleeves associated with the guide assemblies is initiated before compression of the stripper sleeves associated with the punch elements. In all cases, the guide elements move vertically relative to the locater templet by an amount equal to the thickness of the workpiece being punched thereby and remain in such displaced position during punching of subsequent workpieces of like thickness.

Utilization of an assembly formed in accordance with the present invention in an otherwise conventional reusable punching system permits reduction in obtainable center-to-center tolerances from about plus or minus 0.005 inch to about plus or minus 0.001 inch, and therefore greatly increases the versatility of such conventional system.

Moreover, the system of the present invention constitutes an improvement over that described in U.S. Pat. No. 3,125,917 from the standpoint, that is capable of being employed to perform either single or multiple station punching operations on workpieces of substantially varying thickness without resort to thick or multiple piece locater templets.

DRAWINGS

The nature and mode of operation of the present invention will now be more fully described in the following detailed description taken with the accompanying drawings wherein.

DETAILED DESCRIPTION

Figure 1:
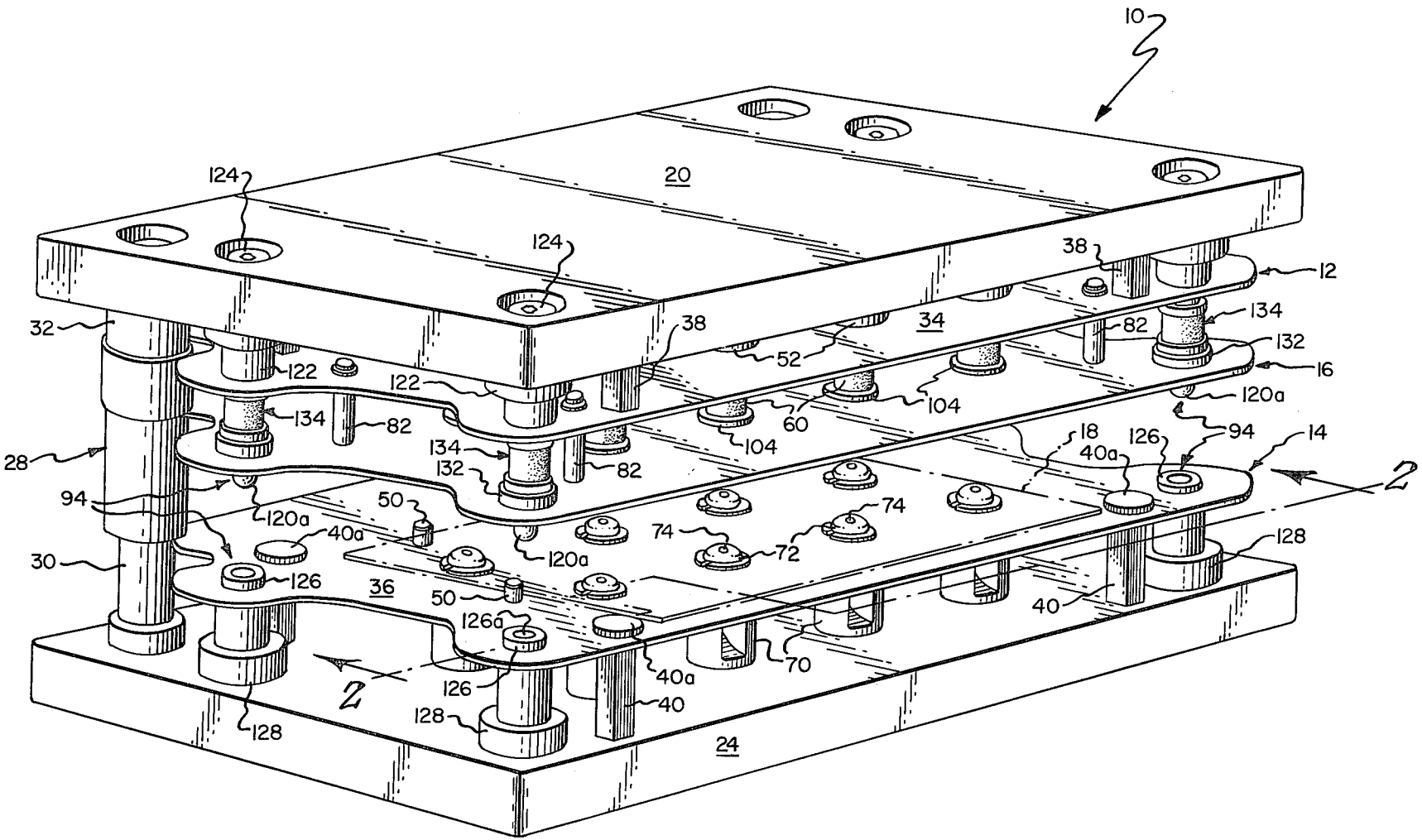
FIG. 1 is a perspective view of a press in open condition showing the assembly of the present invention employed with a conventional reusable type system.

Reference is first made particularly to FIG. 1, wherein a die set is generally designated as 10 and shown as mounting therewithin assembled, reusable punch and die units 12 and 14, respectively, and a close tolerance punching assembly, which is formed in accordance with the present invention and generally designated as 16. A workpiece, such as a piece of sheet metal, on which a punching operation is to be performed, is generally designated at 18.

Figure 2:
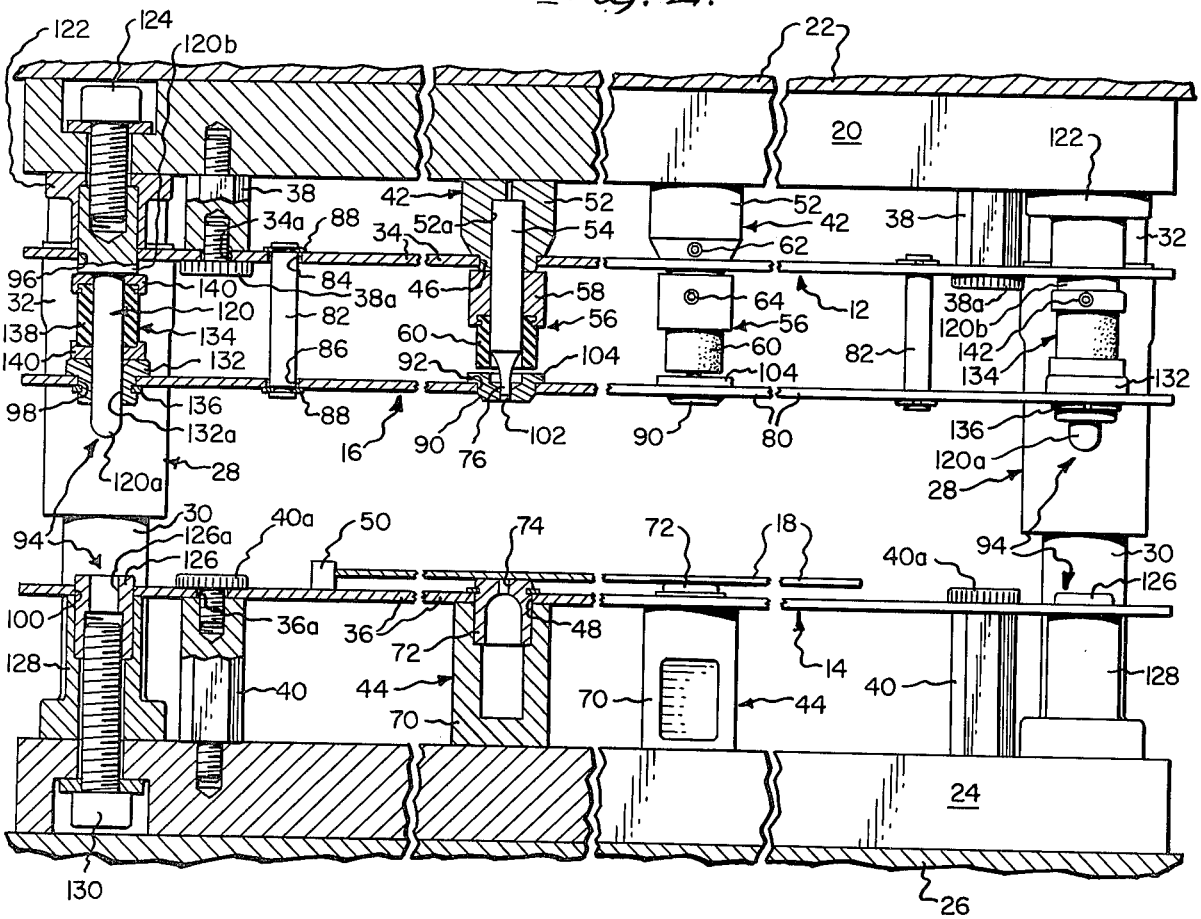
FIG. 2 is a partially sectionalized side elevational view taken generally along the line 2—2 in FIG. 1.
Figure 3:
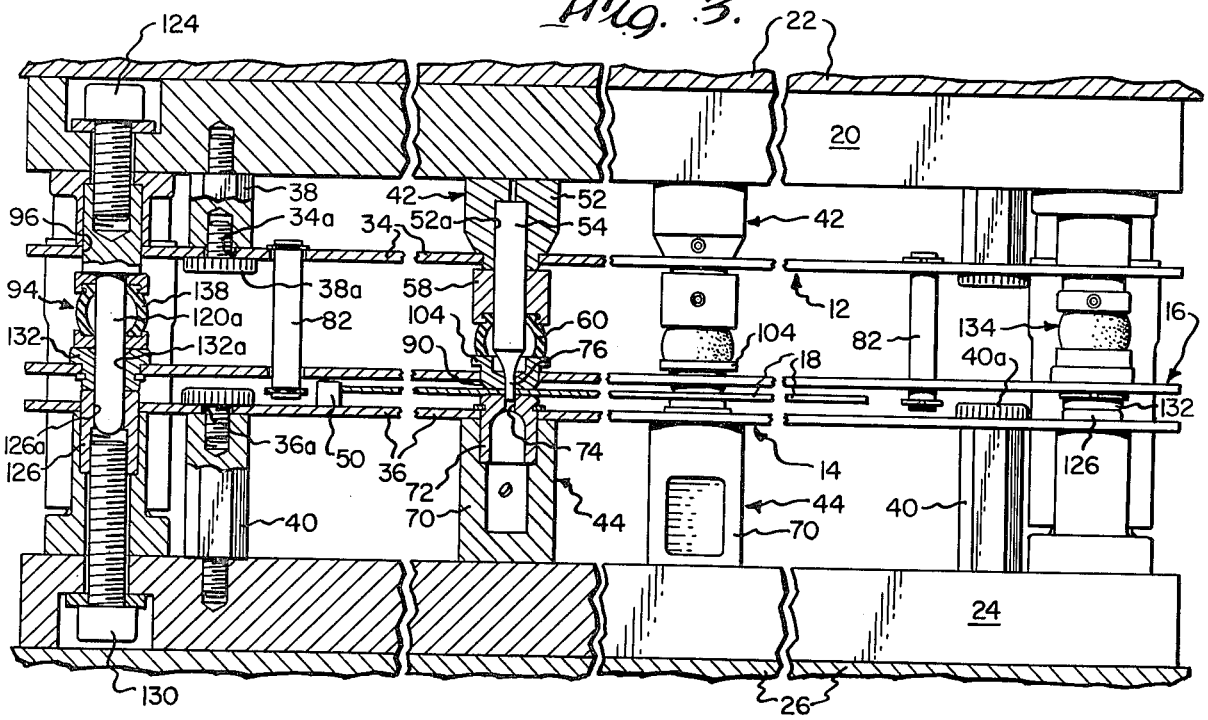
FIG. 3 is a view similar to FIG. 2, but showing the press in closed condition.

Now making reference to FIGS. 1–3, it will be understood that die set 10 is conventional from the standpoint that it includes a punch shoe 20, which is adapted to be suitably secured to a press ram 22; a die shoe 24, which is adapted to be suitably secured to a press bolster 26; a plurality of shoe guide assemblies 28, which include die shoe mounted guide posts 30 and punch shoe mounted guide post receiving bushings 32.

Punch and die units 12 and 14 are conventional from the standpoint that they include punch and die templets 34 and 36, which are in the form of flat metal plates removably secured or attached to punch and die shoes 20 and 24. In the illustrated construction, clamping devices in the form of posts 38 and 40 threadably attached to the punch and die shoes and templet clamping screw devices **38*a* and 40*a* loosely received within punch and die templet openings 34*a* and 36*a* are employed to secure the templets to their respective shoes. Punch and die units 12 and 14 are also shown as including cooperating pairs of punch and die parts 42 and 44, which are positionally located for relative vertical alignment by retainer openings or holes 46 and 48 formed in the punch and die templets. Die unit 14 would normally include a plurality of gauge members 50, which are fixed to upstand from die templet 36 and serve to positionally locate workpiece 18 relative to the punch and die parts during a punching operation. It will be understood that the specific design of the punch and die units will vary with press setup requirements and may incorporate diverse cooperating pairs of metal forming parts, such as may be required to additionally permit embossing, lancing, forming, severing etc. of workpiece 18**.

By now referring to FIGS. 2 and 3, it will be understood that each of punch parts 42 would normally include a punch holder 52, which is positionally located by punch templet opening 46 and in turn formed with a centrally located opening **52*a* sized to receive the upper end portion of a punch 54; and a stripper device 56, which includes a header 58 and a dependent, resiliently deformable stripper sleeve 60. Punch holder 52 may be releasably attached to punch shoe 20 by a magnet device, not shown, and suitable means, such as set screws 62 and 64**, may be employed to releasably clamp punch 54 relative to punch holder 52 and header 58, respectively. Further, each of die parts 44 would normally include a die holder or body portion 70, which is shaped to supportingly receive a die bushing 72 having a centrally located opening 74 sized and shaped to receive the tip or punching end portion 76 of punch 54. Die bushing 72 is positionally located by die templet opening 48, and the force of gravity is normally employed to maintain die holder 70 in supported engagement with the upwardly facing surface of die shoe 24.

It will be understood that reusable punching systems of the type thus far described are conventional and disclosed, as by way of example, in U.S. Pat. Nos. 3,089,376 and 3,782,166 whose disclosures are incorporated herein by reference. It will be also understood that with reusable systems of this type, the above described locater devices are employed to vertically align templet openings 46 and 48, such that the punches and die bushings positioned thereby are arranged in vertical alignment to a degree sufficient to permit the simultaneous punching of multiple holes in workpiece 18 upon converging movement of punch and die shoes 20 and 24 from their open position shown in FIG. 2 into their closed position shown in FIG. 3.

As a practical matter, the characteristics of reusable systems are such as to prevent a punching operation from being performed with the same accuracy as a conventional "fixed" punching system, and thus reusable systems are not now recommended for use where center-to-center tolerances below about plus or minus 0.005 inch must be maintained. Further, with present reusable systems, it is difficult to maintain concentricity between the punch tip and opening of the die bushing and thus it is normally necessary to provide a relatively "loose" 0.003 inch total tolerance between these elements. The lack of concentricity between these elements and their relatively "loose" fitting relationship has heretofore prevented reusable systems from being employed in the punching of sheet materials having thicknesses below about 0.023–0.024 inch.

Reference is again made to FIGS. 1–3, wherein a close tolerance punching assembly 16 formed in accordance with the present invention is shown as including a guide or locater templet 80 in the form of a flat metal plate, which is sized to extend essentially coextensive with punch and die templets 34 and 36. Guide templet 80 is best shown in FIGS. 2 and 3 as being loosely suspended from punch templet 34 to lie essentially parallel and vertically intermediate the punch and die templets by a plurality of supporting pins 82, which loosely extend through openings 84 and 86 in the punch and guide templets and have their opposite ends fitted with snap ring retainers 88.

Assembly 16 additionally includes a plurality of stripper-punch tip guide elements or buttons 90, which are slidably received within locator openings 92 of guide templet 80; and a plurality of guide assemblies 94, which are received within guide openings 96, 98 and 100 of templets 34, 80 and 36, respectively.

Guide elements 90 are shown in FIGS. 2 and 3 as being formed with a centrally located guide opening 102, which is sized and shaped to slidably receive punch tip 76; and an enlarged upper rim portion 104, which serves to prevent movement of the guide elements downwardly through their associated locator openings 92. As will be apparent from viewing FIGS. 2 and 3, the upper and lower surfaces of guide elements 90 are arranged for engagement with the lower ends of the stripper sleeves 60 of the punch parts with which they are associated and workpiece 18, respectively.

Guide assemblies 94 are also best shown in FIGS. 2 and 3 as generally including a stepped diameter guide pin 120 having a relatively small diameter lower end portion 120*a* and a relatively large diameter upper end portion 120*b*, which is positionally received within punch templet guide opening 96 and removably-adjustably fixed to punch shoe 20 by means of a spacer device 122 and clamping bolt 124; a guide sleeve 126, which is positionally received with die templet guide opening 100 and removably-adjustably fixed to die shoe 24 by means of spacer device 128 and clamping bolt 130; a guide bushing 132, which is positionally located within guide templet guide opening 98; and a stripper device 134, which is disposed concentrically of guide pin lower end portion 120*a* and vertically intermediate guide pin upper end portion 120*b* and guide bushing 132. Guide sleeve 126 and guide bushing 132 are formed with centrally located guide openings 126*a* and 132*a*, respectively, which are sized to slidably receive guide pin lower end portion 120*a*. Guide bushing 132 may, if desired, be releasably constrained against axial movement within guide templet guide opening 98 by means of a snap ring retainer 136.

Stripper device 134 is shown as including a resiliently deformable stripper sleeve 138 having its ends snap-fitted or otherwise fixed to a pair of end bearing caps 140, such device being suitably removably fixed to guide pin 120, as by a set screw 142. Preferably, stripper sleeves 60 and 138 would be formed from the same resiliently deformable material and possess essentially the same resistance to deformation.

In accordance with a preferred form of the present invention, a user would be supplied with "blank" punch, die and guide templets of essentially like thickness on the order of about 0.164 inch, wherein the punch, die and guide templets are accurately pre-bored to define guide openings 96, 100 and 98, respectively. The user would complete the manufacturing operation by stacking the templets and then inserting conventional templet clamping plugs, not shown, through associated ones of guide openings 96, 100 and 98 in order to clamp the templets in juxtaposition and place associated ones of the guide openings in accurate vertical alignment, and finally boring the clamped templets to form associated ones of openings 46, 48 and 92, in a number, size and pattern determined by press setup requirements. Fabrication of the templets in this manner serves to eliminate horizontal or center-to-center tolerances between their respective holes. Openings 34*a*, 36*a*, 84 and 86 may be provided in the "blank" templets or subsequently bored by the user, as desired. Alternatively, the punch, die and guide templets may be supplied to a user with all holes pre-bored.

The punch and die units would then be assembled and the punch and die templets fixed to the punch and die shoes using conventional installation techniques in order to arrange associated ones of retainer openings 46 and 48 and associated ones of guide openings 96 and 100 in accurate vertical alignment. More specifically, the assembled punch unit is lifted to place guide pin upper end portions 120*b* within guide openings 96, and the punch unit firmly clamped in place by means of clamping screws 38*a*. The assembled die unit is then lowered to insert guide sleeves 126 within guide openings 100, and the die unit firmly clamped in place by means of clamping screws 40*a*. Installation of the assembled punch and die units in this manner serves to essentially align punch tips 76 with their associated die bushing openings 74 and guide pin end portion 120*a* with guide sleeve opening 126*a*. Conventional techniques may be employed to provide for accurate alignment of guide pins 120 and guide sleeves 126.

It will be understood that guide pin upper end portions 120*b* and guide sleeves 126 functionally replace locator bushings used in prior reusable systems to align the punch and die templets; such bushings having been formed with threaded openings in their facing ends to receive clamping screws identical in function to clamping screws 38*a* and 38*b*. Thus, an important feature of the invention is that customers may have their present reusable systems modified to accommodate assembly 16 by simply replacing their locator bushings with the guide pin and the guide sleeve of the present invention. It is further envisioned that the illustrated holder post and clamping screw arrangement may be dispensed with in favor of guide pin and guide sleeve mounted snap ring retainers, not shown, arranged to engage with the lower and upper surfaces of the punch and guide templets, respectively.

Assembly 16 is completed by attaching stripper devices 134 to their associated guide pins 120; inserting guide elements 90 and guide bushings 132 within their associated templet openings 92 and 98; placing guide templet 80 within die set 10, while it is in its open condition, shown in FIG. 2, and elevating the guide templet to successively insert guide pin lower ends 120*a* within guide bushing openings 132*a* and punch tips 76 within guide element openings 102; and finally suspending the guide templet from punch templet 34 by means of supporting pins 82.

Upon completion of the punch setup operation described above, the several parts of the reusable system incorporating the present invention initially assume the respective positions shown in FIG. 2. At this point it will be understood that an initial spacing exists between the upper surfaces of guide elements 90 and their associated stripper sleeves 60, which is intended to correspond essentially to the maximum thickness of a given range of thicknesses of a workpiece or workpieces to be punched. Also, it will be understood that the axial dimension of guide bushing 132 is chosen to insure that when the press is first closed to effect punching of a workpiece of maximum thickness, the guide bushing will abut or engage with sleeve guide 126 to arrest movement of the guide templet relative to the die templet and initiate compression of stripper sleeve 138 at essentially the same time, but no later than the time, that the guide elements engaged with such workpiece are being forced upwardly from their initial or installed position shown in FIG. 2 to engage with their associated stripper sleeves 60 and initiate compression thereof. When workpieces being punched are of a thickness less than such maximum thickness, compression of stripper sleeves 138 occurs in advance of stripper sleeves 60, that is, templet 80 is arrested before stripper sleeves 60 have been moved downwardly sufficiently to engage with their associated guide elements.

As a practical matter, an initial spacing between the guide elements and their stripper sleeves of 0.1 inch will normally permit punching of stock material varying in thickness between about 0.001 and 0.1 inch without causing deflection or resilient deformation of guide templet 80 sufficient to adversely effect the desired degree of alignment of punch tip 76 and die bushing opening 74 or binding of the punch tip within guide opening 102.

When stock materials in a greater range of thicknesses are to be punched, a differently sized guide bushing 132 must normally be provided and/or spacers, not shown, added to increase the axial length of the original guide bushing to insure compression of stripper sleeves 138 immediately precedent to or essentially simultaneous with compression of stripper sleeves 60. In any event, the initial spacing between guide elements 90 and stripper sleeves 60 and the axial length of the guide element would preferably be such as to prevent punch tip penetration of the workpiece before initiation of compression of stripper sleeve 60.

As will be apparent from viewing FIGS. 2 and 3, the construction of assembly 16 is such as to cause guide pin lower end portions 120*a* to engage within guide sleeve openings 126*a* immediately prior to engagement of guide elements 90 with workpiece 18, whereby to provide for slight horizontal shifting of guide templet 80, as may be required to bring guide openings 98 and 100, and thus openings 92 and 48, into accurate vertical alignment. In that punch tip guide openings 102 are centered within their associated guide elements and openings 74 centered within their associated die bushings, the above described horizontal shifting of guide templet 80 and resultant horizontal movement of punch tips 76 serves to greatly increase the degree of concentricity of the associated punch tips and die bushing openings immediately prior to and during each punch tip penetration of workpiece 18. Alternatively, guide pins 120 could be lengthened to continuously engage with guide sleeves 126, but this construction would necessitate opening of the press beyond its normal die set open position in order to permit insertion/removal of the guide templet and/or alterations in the illustration construction of assembly 16.

After proper alignment of punch tips 76 has been achieved, continued downward movement of punch shoe 20 into die set closed position serves in succession to cause guide templet 80 to move downwardly relative to the guide elements until guide bushing 132 abuts against guide sleeve 126 whereby to define the "lower-operative" position of the guide templet and initiate compression of stripper sleeves 138, and to place guide elements 90 in engagement with workpiece 18 whereby to arrest further downward movement thereof and cause the guide elements to assume "operative" positions relative to the guide templet, as shown in FIG. 3; and finally to effect compression of stripper sleeves 60, as actual punching of the workpiece is effected. Upon die set opening movements of punch shoe 20, guide elements 90 and guide templet 80 are initially maintained in their positions shown in FIG. 3 by the bias of stripper sleeves 60 and 138, as punch tips 76 are drawn into guide element openings 102, whereby to effect stripping of workpiece 18 therefrom. After the punch shoe 20 has been moved upwardly through a distance sufficient to permit the stripper sleeves to fully expand, supporting pins 82 become effective to support guide templet 80 and subsequently lift same for return with punch templet 34 to its initial position shown in FIG. 2. The guide templet when supported by pins 82 may be considered as residing in its "rest" position.

Thus, it will be noted that guide templet 80 and guide elements 90 cooperate to retain punch tips 76 accurately located relative to one another and to provide for horizontal movements of the punch tips as may be required to bring same into accurate alignment with the die bushing openings, whereas the guide elements act independently of the guide templet in connection with the clamping and subsequent stripping of workpiece 18. This arrangement coupled with the above described operation of stripper sleeves 60 and 138 serves to prevent the application of workpiece stripping forces to the relatively thin gage templet, which might otherwise cause deformation thereof and resultant misalignment of the punch tip and die bushing and/or excessive binding between and wearing away of the punch tips and guide elements.

It will be understood that the displacement of guide elements 90 between their initial or installed positions shown in FIG. 2 and their operative positions shown in FIG. 3 corresponds to the thickness of workpiece being punched. Further, it will be understood that guide elements tend to remain in such operative positions, during subsequent punching operations which a given press setup is intended to perform on a series of workpieces having the same thickness. This is due to the provision of a relatively tight sliding fit between the guide elements and their associated templet openings and to the lack of any attachment between the guide elements and their associated stripper sleeves. This is a particularly desirable feature of the present construction, since the ability of the guide elements to remain in their operative positions after the initial punching operation prevents tolerance change producing wear at the interfaces of the guide elements and the guide templet. Also, once the present system is set up to punch workpieces falling within a given range of thicknesses, e.g. between about 0.001 and 0.1 inch, the individual guide elements may automatically adjust themselves relative to the guide templet, as required to accommodate for multiple-station punching operations performed on workpieces of different thickness falling within such given range.

As indicated above, by the utilization of assembly 16, punched hole center-to-center tolerances of plus or minus 0.001 inch are now readily achievable with a conventional reusable punching system heretofore capable of consistently obtaining center-to-center tolerances only of about plus or minus 0.005 inch. The substantial increase in the degree of concentricity of the punch tips and their associated die bushing openings, which is now obtainable by a conventional reusable system incorporating assembly 16, yields the additional advantage of allowing such system to be employed in the punching of thinner stock material than heretofore possible.

What is claimed is:

1. In a system for punching workpieces including:

a die set including punch and die shoes, said punch shoe being mounted for vertical movement relative to said die shoe between open and closed positions;

a punch templet in the form of a metal plate fixed to said punch shoe and having a plurality of guide openings and a plurality of retainer openings;

a die templet in the form of a metal plate fixed to said die shoe and having a plurality of guide openings and a plurality of retainer openings, the pattern and center-to-center spacing between said openings of said punch and die templets being equal and associated ones of said openings of said punch and die templets being disposed in vertical alignment;

a plurality of punch parts positionally located one within each of said punch templet retainer openings, each of said punch parts including a punch fixed within its associated punch templet retainer opening and a resiliently deformable stripper device, said punch extending towards said die templet and terminating in a punch tip;

a plurality of die parts positionally located one within each of said die templet retainer openings and associated one with each of said punch parts, each of said die parts including a die bushing formed with an opening sized and shaped to receive said punch tip of an associated punch part for effecting punching of said workpieces in alignment therewith during movement of said shoes into said closed position;

a guide templet having a plurality of guide openings and a plurality of locater openings characterized as having a pattern and center-to-center spacing equal to said guide and retainer openings of said punch and die templets;

a plurality of guide elements slidably received one within each of said locator openings for association one with each of said punch parts, each of said guide elements having an upper surface, a lower surface, a supporting portion and a guide opening sized and shaped to slidably receive said punch tip of its associated punch part, said guide elements being insertable into their associated locator openings to place said supporting portion in engagement with an upper surface of said guide templet and said lower surface relatively below a lower surface of said guide templet;

supporting means for normally suspending said guide templet from said punch shoe for vertical movement therewith while permitting movement of said punch templet relative to said guide templet when it is in a lower-operative position thereof, said guide templet being arranged horizontally intermediate said punch and die templets with each of said guide elements positionally locating said punch tip of its associated punch part within the guide opening thereof and being arranged for upper and lower surface engagement with said stripper device of its associated punch part and said workpiece arranged in alignment therewith, respectively, during movement of said punch shoe towards closed position; and a plurality of guide assemblies, each of said guide assemblies including a guide pin having an upper end portion fixed to said punch shoe and a lower end portion, a guide sleeve fixed to said die shoe and a guide bushing, said guide sleeve and said guide bushing having centrally located guide openings sized to slidably receive said lower end portion of said guide pin, said upper end portion of said guide pin, said guide sleeve and said guide bushing being positionally located within associated ones of said guide openings of said punch, die and guide templets, respectively, characterized in that receipt of the guide pin lower end portions within their associated guide sleeve openings at least during a portion of the movement of said punch shoe towards closed position serves to vertically align said guide openings of said guide templet with said guide openings of said die templet, whereby said guide templet and said guide elements are operative to position the punch tips in vertical alignment with the openings of their associated die bushings, the improvement in combination for punching workpieces ranging in thickness up to a maximum thickness and selectivity in a single or multiple station operation:

said guide templet is in the form of a metal plate having a thickness corresponding to the thickness of said plates forming said punch and die templets, said guide templet when suspended by said supporting means spacing said upper surface of each of said guide elements from its associated stripper device through a distance essentially equal to said maximum thickness, when the supporting portions of said guide elements engage with an upper surface of said guide templets, said guide pin of each of said guide assemblies is of stepped diameter having a relatively large diameter upper end portion and a lower relatively small diameter end portion, and each of said guide assemblies additionally includes a resiliently deformable stripper device arranged for opposite end engagement with said upper end portion of said guide pin and said guide bushing, said guide bushings being engagable with their associated guide sleeves during a further portion of movement of said punch shoe towards closed position to arrest movement of said guide templet relative to said die templet to define said lower-operative position of said guide templet and to initiate deformation of said stripper device of each said guide assembly, said distance between said upper surface of each of said guide elements and its associated stripper device accommodating for engagement therebetween and initiation of resilient deformation of such stripper device during movement of said punch shoe towards closed position no sooner than initiation of deformation of the stripper devices of said guide assemblies, and said punch tips being forced to move relative to said guide elements and into said openings of their associated die bushings to effect punching of said workpiece, during a still further portion of the movement of said punch shoe into closed position.

2. A system according to claim 1, wherein said supporting means includes a plurality of supporting pins having upper and lower ends thereof freely and slidably received within aligned openings formed in said punch and guide templets and means carried by said upper and lower ends of said supporting pins and arranged for engagement with upper and lower surfaces of said punch and guide templets, respectively.

3. In a reusable punching system adapted to effect punching of workpieces and including punch and die shoes, wherein said punch shoe is mounted for vertical movement between open and closed positions; a punch templet fixed to said punch shoe, said punch templet having a plurality of retainer openings; a die templet fixed to said die shoe, said die templet having a plurality of retainer openings; a plurality of punch parts positionally located one within each of said punch templet retainer openings, each of said punch parts including a punch and a resiliently deformable workpiece stripper device, each said punch being located within one of said punch templet retainer openings, extending in a direction towards said die templet and terminating in a punch tip; a plurality of die parts operably associated one with each punch part and positionally located one by each of said die templet retainer openings, each of said die parts including a die bushing formed with an opening sized and shaped to receive said punch tip of a punch part with which it is associated, said punch and die templets being oriented to place said retainer openings thereof in accurate vertical alignment, whereby to vertically align associated ones of the punch tips and the die bushing openings to a degree sufficient to effect punching of workpieces when arranged intermediate said punch and die templets during movement of said punch shoe into said closed position;

a guide templet having a plurality of locater openings extending therethrough;

a plurality of stripper-punch tip guide elements, said guide elements being slidably received within and extending one through each of said locater openings, said guide elements each defining a guide opening extending therethrough, each said guide opening being sized and shaped to slidably receive an associated one of said punch tips, and each of said guide elements having a supporting portion adapted for engagement with an upper surface of said guide templet, an upper stripper engaging surface and a lower workpiece engaging surface;

supporting means for suspending said guide templet to assume a rest position relative to said punch templet, wherein said guide templet is disposed vertically intermediate said punch and die templets with said guide elements arranged for opposite surface engagement with a workpiece aligned therewith and said stripper device and with said punch tip inserted within said guide opening, said supporting means permitting movement of said guide templet relatively towards said punch templet from said rest position; and means for operably interconnecting said punch, die and guide templets for shifting said guide templet horizontally during movement of said punch shoe towards closed position and prior to engagement of said punch tips with said workpieces as required to place said locater openings in vertical alignment with said retainer opening of said die templet and thereby to more accurately align said punch tips with said die bushing openings prior to and during punching of said workpieces, the improvement for more accurately aligning said punch tip with said die bushing opening and for permitting single or multiple station punching of workpieces having a given range of thickness including a maximum and a minimum thickness, including in combination:

said guide templet when suspended in said rest position spacing the upper surfaces of said guide elements from their associated stripper devices through a distance corresponding to said maximum thickness when the supporting portion of said guide elements engage with said upper surface of said guide templet, said means for interconnecting said punch, die and guide templets being operable to move said guide templet while in said rest position with said punch templet in a direction towards said die templet during movement of said punch shoe towards closed position to thereby move said guide elements downwardly towards said workpiece and then arrest movement of said guide templet relative to said die templet no later than initiation of compression of the stripper devices associated with the guide elements engaged with said workpiece and said means for interconnecting said punch, die and guide templets being thereafter operable to prevent movement of said guide templet relative to said die templet until return movement of said punch templet with said punch shoe into open position sufficient to return said guide templet to said rest position.

4. The improvement according to claim 3, wherein said supporting means includes a plurality of supporting pins having upper and lower ends there of freely and slidably received within aligned openings formed in said punch and guide templets and means carried by said upper and lower ends of said pins and arranged for engagement with upper and lower surfaces of said punch and guide templets, respectively.

5. The improvement according to claim 3, wherein the means for interconnecting said punch, die and guide templets includes a plurality of guide assemblies, each of said guide assemblies including a stepped diameter guide pin having a relatively large diameter upper end portion fixed to said punch shoe and a lower relatively small diameter end portion, a guide sleeve fixed to said die shoe and slidably receiving said lower end portions, a guide bushing slidably supported on said lower end portion and a resiliently deformable stripper device arranged for opposite end engagement with said upper end portion of said guide pin and said guide bushing, said upper end portion of said guide pin, said guide sleeve, and said guide bushing being positionally located within aligned guide openings formed in said punch, die and guide templets, respectively, the guide bushings of said guide assemblies being maintained at least in proximate surface engagement with their associated stripper devices by said guide templet when suspended in said rest position, and said guide bushings engaging with their associated guide sleeves to arrest movement of said guide templet.

6. A method of increasing the accuracy of a conventional reusable system employed in the punching of workpieces, having a given range of thicknesses up to and including a maximum thickness in either a single or multiple station operation, wherein said reusable system includes in combination punch and die shoes wherein said punch shoe is mounted for verticle movement relative to said die shoe between open and closed positions; a punch templet, said punch templet having a plurality of retainer openings; a die templet, said die templet having a pluality of retainer openings arranged in a pattern and center-to-center spacing corresponding to the pattern and center-to-center spacing of said retainer openings of said punch templet; means to fix said punch and die templet to said punch and die shoes, respectively, whereby to arrange associated ones of said retainer openings of said punch and die templets in vertical alignment; a plurality of punch parts positionally located one within each of said punch templet retainer openings, each of said punch parts including a punch and a resiliently deformable stripper device disposed concentrically of said punch, said punch having an upper end centrally located within its associated retainer opening and extending in a direction towards said die templet to terminate in a punch tip extending below said stripper device; a plurality of die parts positionally located one within each of said die templet retainer openings in vertical alignment with an associated one of said punch parts, each of said die parts including a die bushing formed with a centrally located opening sized and shaped to receive a punch tip of an associated punch part, associated ones of said punch and die parts having their punch tips and die bushing openings vertically aligned to a degree sufficient to effect punching of said workpiece when arranged intermediate said punch and die templets during movement of said punch shoe into said closed position;

a guide templet fabricated simultaneously with said punch and die templets by stacking said punch, guide and die templets in juxtaposition and simultaneously forming a plurality of aligned guide openings in the stacked templets and simultaneously forming a plurality of other aligned openings in the stacked templets wherein associated ones of said other openings of said templets define said retainer openings of said punch and die templets and locator openings of said guide templet, wherein the pattern and center-to-center spacing of said guide and retainer openings of said punch and die templets is identical to the pattern and center-to-center spacing of said guide and locator openings of said guide templet; and a plurality of guide elements slide fitted one within each of said locator openings, each of said guide elements having a supporting portion and a through guide opening sized and shaped to slidably receive an associated one of said punch tips determined by that one of said punch parts received within that one of said retainer openings with which its locator opening is associated, said method comprising the steps of:

providing a relatively tight slide fit for said guide elements within their associated locator openings;

arranging said guide templet intermediate said punch and guide templets at least when said punch shoe is in said open position to insert said punch tips within their associated guide element openings and to provide for initial vertical spacing between said guide elements when said supporting portion is engaged with an upper surface of said guide templet and said stripper devices essentially equal to said maximum thickness;

moving said guide templet with said punch templet downwardly towards said die templet as said punch shoe is moved towards closed position sufficiently to bring lower surfaces of said guide elements into engagement with said workpieces when aligned therewith and effect sliding movement of engaged ones of said guide elements upwardly within said locator openings through a distance corresponding essentially to the thickness of said workpieces with which they engage, whereby engaged ones of said guide elements are caused to assume operative positions thereof;

locating said guide openings of said guide templet in vertical alignment with said guide openings of said die templet at least during the step of moving said guide templet towards said die templet and prior to movement of said guide elements into said operative positions thereof, whereby to locate said punch tips in vertical alignment with their associated die bushing openings;

continuing movement of said punch shoe into closed position through a vertical distance sufficient to effect resilient deformation of said stripper devices due to engagement with their associated engaged ones of said guide elements and to force said punch tips to project downwardly below their associated guide elements to effect punching of said workpieces when aligned therewith;

arresting movement of said guide templet relative to said die templet during said continuing movement of said punch shoe no later than initiation of resilient deformation of said stripper devices and continuing to arrest movement of said guide templet relative to said die templet during return movement of said punch shoe towards open position at least until termination of resilient deformation of said stripper devices; and thereafter lifting said guide templet for movement with said punch templet during continued movement of said punch shoe into open position, characterized in that said guide elements tend to remain in said operative positions thereof during subsequent closing and opening movements of said punch shoe for performing punching operations on successive workpieces of the same thickness.

* * * * *